US006147586A

United States Patent [19]

Saitoh et al.

[11] Patent Number: 6,147,586

[45] **Date of Patent: *Nov. 14, 2000**

[54] PLATE FUSE AND METHOD OF PRODUCING THE SAME

[75] Inventors: Yasushi Saitoh, Nagoya; Jun Yasukuni, Yokkaichi, both of Japan

[73] Assignees: Sumitomo Wiring Systems, Ltd.; Harness System Technologies Research, Ltd.; Sumitomo Electric Industries, Ltd., all of, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/114,959

[22] Filed: Jul. 13, 1998

Related U.S. Application Data

[62] Division of application No. 08/694,106, Aug. 8, 1996, Pat. No. 5,805,048.

[30] Foreign Application Priority Data

Sep. 1, 1995 [JP] Japan ..... 7-248652
Oct. 5, 1995 [JP] Japan ..... 7-286548

[51] Int. Cl.[7] ..... H01H 85/04; H01H 85/143

[52] U.S. Cl. ..... 337/297; 337/268; 337/416; 337/293; 29/623

[58] Field of Search ..... 29/623, 829, 832, 29/869, 887; 337/160–190, 201, 227, 293, 295, 290, 414–417, 268, 297

[56] References Cited

U.S. PATENT DOCUMENTS

| | | | |
|---|---|---|---|
| 3,331,718 | 7/1967 | Ruffing | 29/829 |
| 3,501,833 | 3/1970 | Spiegler | 29/832 |
| 3,585,556 | 6/1971 | Hingorany et al. | 337/297 |
| 4,027,521 | 6/1977 | McKee et al. | 29/629 |
| 4,037,318 | 7/1977 | Burkley et al. | 29/623 |
| 4,149,137 | 4/1979 | Konnemann | 337/295 |
| 4,203,200 | 5/1980 | Wiebe | 29/756 |
| 4,376,927 | 3/1983 | McGalliard | 337/297 |
| 4,434,548 | 3/1984 | Beswick | 29/623 |
| 4,495,546 | 1/1985 | Nakamura et al. | 29/837 |
| 4,617,733 | 10/1986 | Olson | 29/874 |
| 4,675,990 | 6/1987 | Viola et al. | 29/623 |
| 4,706,059 | 11/1987 | Schmitt | 337/297 |
| 4,862,134 | 8/1989 | Poerschke et al. | 29/623 |
| 5,065,506 | 11/1991 | Kiribayashi | 29/832 |
| 5,115,220 | 5/1992 | Suuronen et al. | 337/297 |
| 5,148,141 | 9/1992 | Suuronen | 337/297 |
| 5,781,096 | 7/1998 | Yasukuni et al. | 337/297 |
| 5,790,007 | 8/1998 | Yasukuni | 29/623 |
| 5,841,338 | 11/1998 | Yasukuni | 337/293 |

FOREIGN PATENT DOCUMENTS

| | | | |
|---|---|---|---|
| 2032205 | 4/1980 | United Kingdom | 29/623 |

*Primary Examiner*—Leo P. Picard
*Assistant Examiner*—Anatoly Vortman
*Attorney, Agent, or Firm*—Bierman, Muserlian and Lucas

[57] ABSTRACT

An insulation plate (20) is provided with a window or a slot (21). A fusible element or circuit (31) is laid on a surface of the insulation plate (20) across the window (21). When the circuit (31) is heated by current-conduction, a fusible path (33) of the circuit (31) spanned in air across the window (21) melts at a predetermined current level, since heat generated in the fusible path (31) is not absorbed in the insulation plate (20). It is possible to transform the plate fuse depending on the conditions of use, and its configuration is substantially flexible.

3 Claims, 13 Drawing Sheets

PLATE FUSE AND METHOD OF PRODUCING THE SAME

This Application is a Division of U.S. Ser. No. 08/694,106, filed Aug. 08, 1996, now U.S. Pat. No. 5,805,048, which, in turn, claims the priority of Japanese Applications 248,652/1995, filed Sep. 1, 1995, and 286,548/1995, filed Oct. 5, 1995.

BACKGROUND OF THE INVENTION (1) Field of the Invention

This invention relates to a plate fuse and a method of producing the same, and more particularly relates to such a fuse and production method in which a conductive fusible element having a given current capacity is arranged on a surface of an insulation plate.

(2) Statement of the Prior Art

Heretofore, a conventional joint connector has been known from, for example, Japanese Patent Public Disclosure No. HEI 6-333628 (1994). For convenience of explanation, the conventional plate fuse and another type of fuse are described below with reference to FIGS. 26 to 28. FIG. 26 is an explanatory view illustrating a method of producing a conventional plate fuse. FIG. 27 is an explanatory view illustrating a method of producing a conventional plate fuse. FIG. 28 is an exploded perspective view of another conventional fuse.

A plate fuse shown in FIGS. 26 and 27 includes an insulation plate 1 and a fusible element 2 which is formed by etching a metal thin film deposited on the insulation plate 1.

When a current over a given value is applied to the thin film fusible element 2 on the insulation plate 1, the element 2 is heated and melts.

On the other hand, another similar fuse or a blade type fuse, which is not a plate fuse, as shown in FIG. 28, includes a pair of terminals 3, 3 made of a thick metal plate, a string-like fusible element 4 which interconnects the terminals 3, 3 and a resin cover 5.

The conventional plate fuse described above has the following problems.

A current capacity is not accurate, since a part of the heat is absorbed in the insulation plate 1 when the fusible element 2 is heated. Also, the insulation plate 1 produces white smoke or an offensive smell since melting of the fusible element 2 on the insulation plate 1 scorches it.

The conventional plate fuse requires additional working steps and time for etching process or vaporization process.

On the other hand, in the blade type fuse, the terminal 3 requires a thicker metal plate and the string-like fusible element 4 requires to be cut or punched. This results in high production costs. Having a thick metal plate with a large cross sectional area also makes it difficult to form low current capacity and multiple poles.

SUMMARY OF THE INVENTION

An object of the present invention is to provide a plate fuse which provides good performance, produces no white smoke or offensive smell, can be easily produced, and can provide low current capacity and multiple poles.

Another object of the present invention is to provide a method of producing a plate fuse by means of a dry process.

In order to achieve the above first object, a plate fuse in accordance with the present invention comprises: an insulation plate made of a flexible insulation film and provided with a window having a given shape; and a conductive circuit laid on a surface of the insulation plate and including a fusible path with a given current capacity and electric poles each formed on each of the opposite ends of the fusible path. The opposite electric poles are adapted to be connected to an external circuit. The fusible path is spanned in air across the window.

The insulation plate may be bent at a portion including the window. Preferably, the insulation plate may be reinforced at portions to be connected to the external circuit. The plate fuse may be mounted in a connector which clamps opposite ends of the insulation plate and brings terminals into contact with the fusible path on the surface of the insulation plate. The fusible path projects outwardly from opposite ends of the insulation plate to form terminal portions. The terminal portions may be soldered to the external circuit. A plurality of conductive circuits may be commonly connected to one of opposite ends thereof.

In the plate fuse of the present invention, the insulation plate is provided with the window and the fusible element or path is spanned in air across the window. Although heat generated by current-conduction in a part of the fusible element which comes into contact with the insulation plate is absorbed into it, heat in the generated remaining the part situated in air across the window is not absorbed into the insulation plate. Consequently, the part of the fusible element spanned in air across the window melts and thereby breaks at a predetermined current level. The plate fuse can be transformed depending on the laying position, since the insulation plate which supports the fusible element is made of an insulation film.

The fusible element can be laid on the insulation plate by a dry process in which the fusible element is punched out from the fusible metal sheet and disposed on the insulation plate. When the fusible element is connected to the external circuit, the insulation plate receives any external force. The insulation plate is reinforced at the connecting portion to the external circuit, thereby preventing it from being broken. Since the insulation plate is bent at the window, the fusible element spanned in air across the window is similarly bent. This configuration helps to prevent stress concentration from heat expansion and contraction. It is also possible to connect the fusible element to an external circuit by clamping opposite ends of the insulation plate so that the terminals come into contact with opposite ends of the fusible element. The fusible element projects at opposite ends outwardly from the opposite ends of the insulation plate to form terminal parts which are adapted to be connected to the external circuit. It is possible to electrically secure the projecting ends of the fusible element to the external circuit by means of soldering.

According to the present invention, the fusible element melts and breaks without any ambient influence from the insulation plate when current flows over a given level, and the molten fuse neither scorches the insulation plate nor produces white smoke or an offensive smell. Since the plate fuse of the present invention is sufficiently flexible to accommodate the laying space, it has enhanced application in comparison with a conventional rigid plate fuse.

Also, according to the present invention, it is possible to readily produce the plate fuse by a dry process in which the fusible element is punched from the fusible metal sheet and provided on the insulation plate. It is also possible to adjust a current capacity by changing a width of the fusible element to be punched out. Moreover, it is possible to increase the current capacity by disposing a plurality of fusible elements on the insulation plate.

Further, although a low strength insulation film is used, it is possible to keep the insulation plate flexible by reinforcing the portion to be connected to the external circuit. Such a portion will be subject to maximum external forces. It is also possible to prevent a stress concentration due to heat expansion and contraction and to enhance durability since the fusible element is bent in air across the window. The plate fuse can be easily attached to and detached from the connector which clamps opposite ends of the insulation plate so that the terminals come into contact with the fusible element on the insulation plate. The plate fuse provided with terminals which are formed by projecting the fusible element at opposite ends from the insulation plate can be coupled to the external circuit without using any connector. In the case where a connector cannot be used in a narrow space, the projected terminals of the fusible element can be soldered to the external circuit.

In order to achieve another object, a method of producing a plate fuse in accordance with the present invention, comprises the steps of: forming an insulation plate with a given configuration made of a flexible insulation film and provided with a window having a given shape; punching a metal sheet into a conductive circuit including a fusible path with a given capacity and electric poles each formed on each of the opposite ends of said fusible path; and securing said conductive circuit onto a surface of said insulation plate so that said fusible path is spanned in air across said window.

Preferably, the insulation plate is bent in a U-shape after said conductive circuit is laid on said insulation plate. A plurality of conductive circuits may be integrally formed by a punching process and said circuits thus formed are together on said insulation plate. The conductive circuits are coupled together by carriers upon the punching process and said carrier are removed from the conductive circuits after said circuits are laid on said insulation plate.

According to the present invention, it is possible to produce the plate fuse by a dry process in which the conductive circuit is punched out from the fusible metal sheet and laid on the insulation plate, thereby arranging the opposite end poles and fusible path on the insulation plate.

Moreover, the insulation plate can be made of an insulation film and be provided with the window. The fusible element is punched out from the fusible metal sheet to present a given current capacity. The fusible element is disposed on the insulation plate across the window.

The method of the present invention can easily produce a plate fuse merely by laying the punched fusible element on the insulation plate. In particular, since the fusible element is carried on the insulation film, the fusible element may be of low strength and thickness. It is also possible to easily adjust the current capacity of the plate fuse by changing the width of the fusible element or increasing the area in cross section by piling the fusible elements one by one.

It is also possible to produce the plate fuse provided with a plurality of conductive circuits by punching out together the conductive circuits from the fusible metal sheet by the punching process and laying together the circuits on the insulation plate. Upon punching out together a plurality of conductive circuits from the fusible metal sheet, the circuits may be continued to each other at one of opposite side edges. The conductive circuits may be supported by carriers at the time when the circuits are punched out from the fusible metal element. Then, the carrier may be removed from the circuits after the circuits are laid on the insulation plate. After the conductive circuit is laid on the insulation plate, it may be bent in a U-shape to form a current path from a front side to a rear side. The conductive circuit can be spanned in air across the window so as to readily melt with the insulation plate being bent after the circuit is laid on the insulation plate across the window.

According to the method of the present invention, it is possible to easily produce a plate fuse by the dry process in which the fusible element is punched out from the fusible metal sheet and the fusible element is laid on the insulation plate. The current capacity of the plate fuse can be readily adjusted by changing the width of the fusible element. Further, the current capacity can be increased by using multiple fusible elements.

A plate fuse having a plurality of conductive circuits can be easily produced by punching out conductive circuits together from the fusible metal sheet and laying them on the insulation plate. At this time, the conductive circuits can have different current capacities, respectively by forming the fusible elements into different widths. When the conductive circuits are formed, they do not separate from each other if they have a common portion at their ends, thereby saving labor. Since the punched conductive circuits are transferred to the insulation plate while being supported by the carriers, positioning of the circuits on the plate is easy and increases working efficiency. It is also possible to produce the plate fuse which has an electrical pole on the opposite side. It is possible to set a portion to be molten in the fusible element by spanning it in air.

DETAILED DESCRIPTION OF THE PREFERRED EMBODIMENTS

Figure 1:
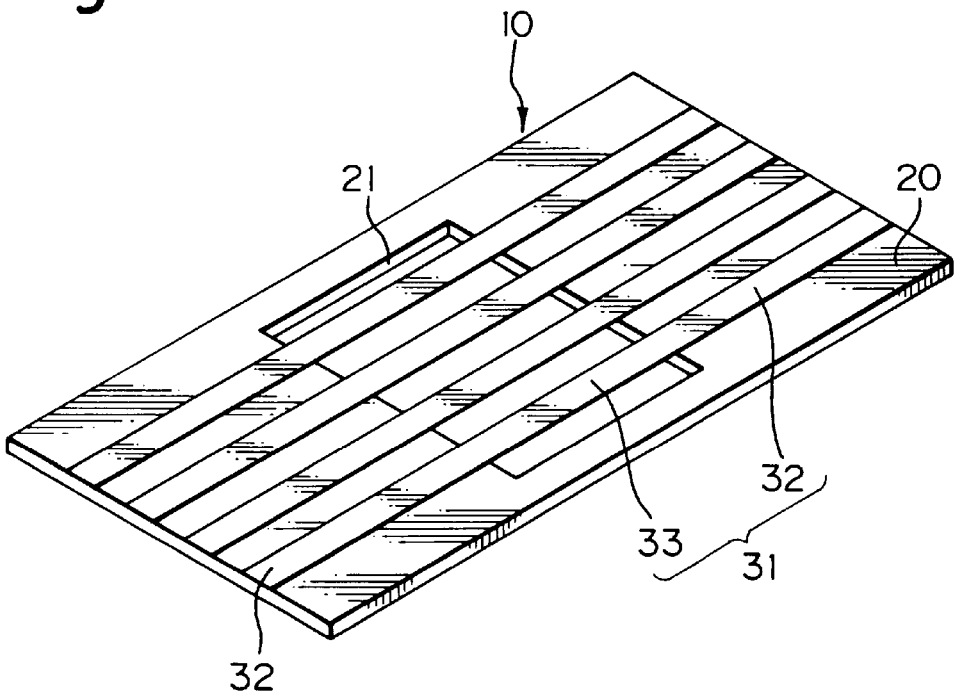
FIG. 1 is a perspective view of an embodiment of a plate fuse in accordance with the present invention.

Referring now to the drawings, embodiments of a plate fuse in accordance with the present invention will be described below.

FIG. 1 is a perspective view of an embodiment of a plate fuse 10 in accordance with the present invention.

In FIG. 1, an insulation plate 20, which is made of an insulation film and is formed into a rectangular shape, is provided in a middle portion with a window or slot 21 which extends across a substantially whole width of the plate 20. Four circuits 31 made of a tape-like fusible element are laid on a surface of the insulation plate 20 in parallel with each other. Each circuit 31 includes an electric pole 32 on its opposite ends and a fusible path 33 between the opposite electric poles 32 and 32, in particular in air across the slot 21.

In this embodiment, the insulation plate 20 has a suitable flexibility and can be transformed, if desired, since it is made of an insulation film. Although the circuit 31 including the fusible element is laid on the surface of the flat insulation plate 20, the circuit 31 may be laid on the surface of a U-shaped insulation plate 20 shown in FIG. 2, which is bent beforehand. The insulation plate 20 is not necessarily rectangular. It may be formed into any suitable shape such as an L-shape, a U-shape or the like in accordance with an application space. Moreover, a plurality of circuits 31 do not necessarily cross a single common slot 21. Each circuit 31 may cross each slot 21.

Figure 3:
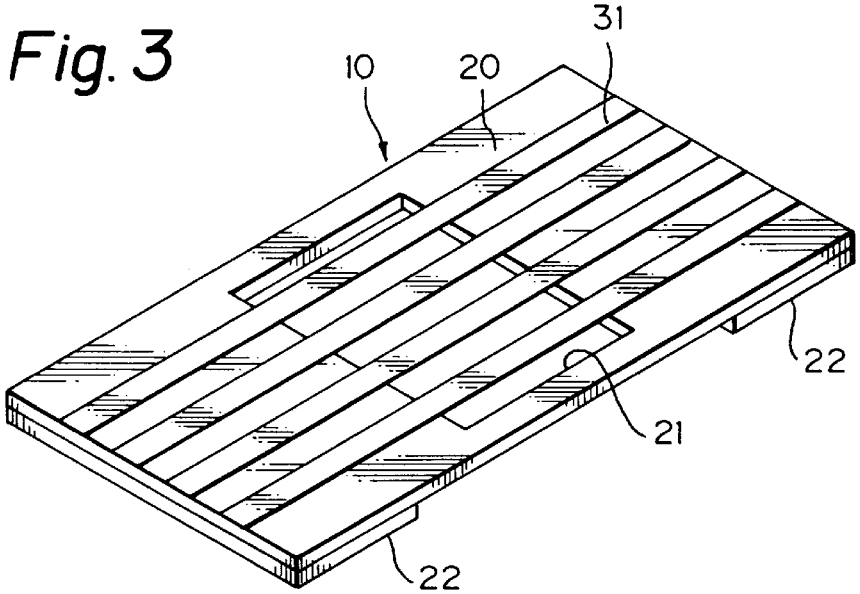
FIG. 3 is a perspective view of another embodiment of the plate fuse in accordance with the present invention.
Figure 4:
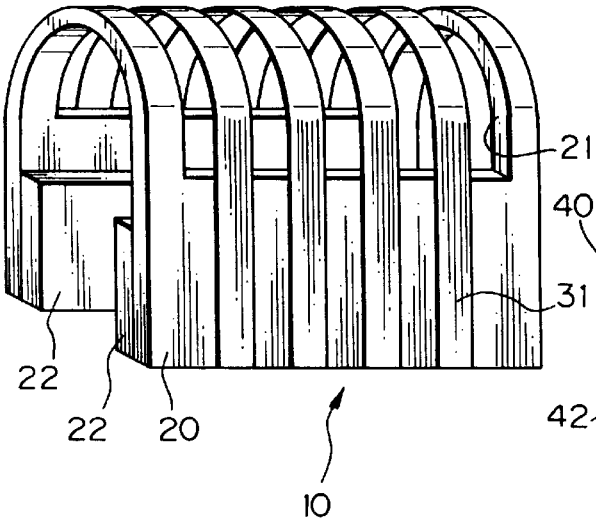
FIG. 4 is a perspective view of a bent plate fuse made of the plate fuse shown in FIG. 3.
Figure 5:
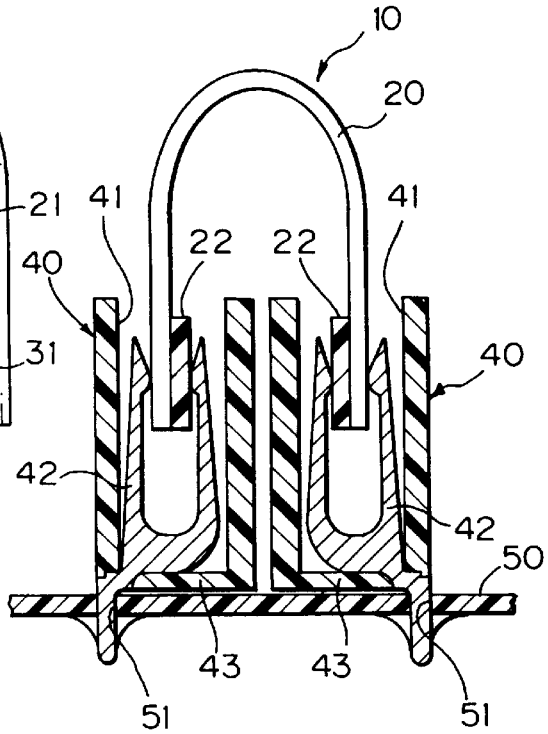
FIG. 5 is a cross sectional view of the bent plate fuse shown in FIG. 4, which is inserted in a socket.

Since the insulation plate 20 is made of the insulation film, it can be made of a more flexible material if desired. The more flexible the plate 20 becomes, the more breakable it becomes. In this case, the insulation plate 20 may be provided on its rear side with a pair of reinforcing plates 22 which enhance the strength of the plate 20, as shown in FIGS. 3 and 4. In order to attach such a plate fuse 10 to a device, a pair of sockets 40, 40 may be used, as shown in FIG. 5. The socket 40 has an opening 41 to receive each of the opposite ends of the plate fuse 10 because the circuit 31 is exposed on the surface of the insulation plate 20.

As shown in FIG. 5, each socket 40 includes a U-shaped stationary electric pole 42 which can clamp the electric pole 32 of the plate fuse 10 in the opening 41. An end of the stationary electric pole 42 penetrates a bottom wall 43 in the opening 41 and extends rearwards. The sockets 40, 40 are mounted on a print substrate 50 so that the stationary electric poles 42, 42 pass through holes 51, 51 in the print substrate 50. The poles 42, 42 are soldered to the print substrate 50 at their projecting ends. Thus, when the opposite ends of the plate fuse 10 are inserted into the sockets 40, 40, a print circuit on the print substrate 50 will be electrically conducted through the circuit 31.

In the case where the plate fuse 10 is mounted on the socket 40, the end of the insulation plate 20 is inserted into the stationary electric pole 42. In this case, it is possible to increase the strength of the plate fuse while maintaining its flexibility by means of attachment of the reinforcing plate 22, since the stationary electric pole 42 not only comes into contact with the electric pole 32 of the plate fuse 10 but also supports it.

Figure 8:
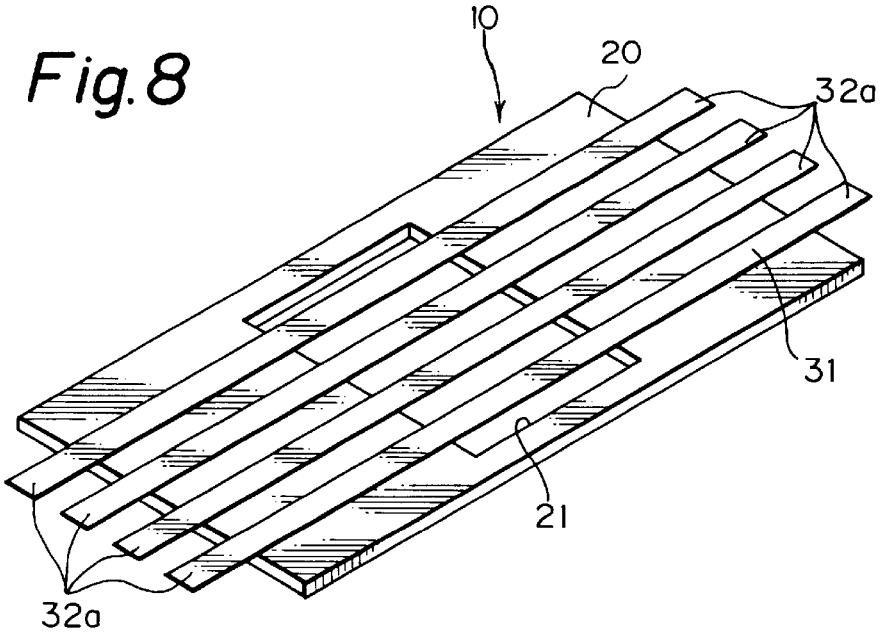
FIG. 8 is a perspective view of still another embodiment of a plate fuse in accordance with the present invention.
Figure 9:
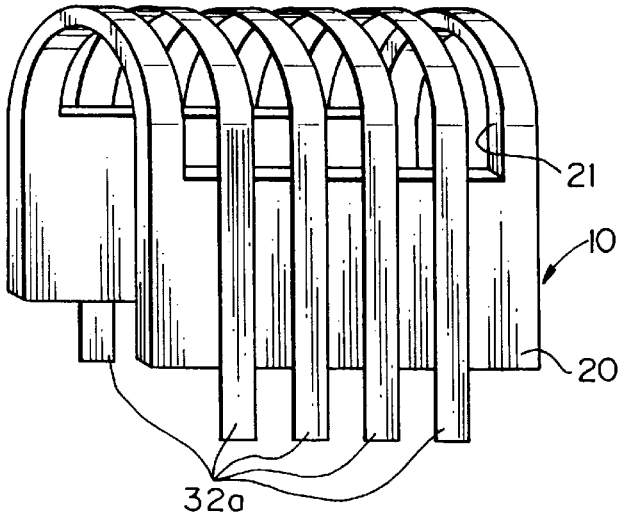
FIG. 9 is a bent plate fuse made of the plate fuse shown in FIG. 8.
Figure 10:
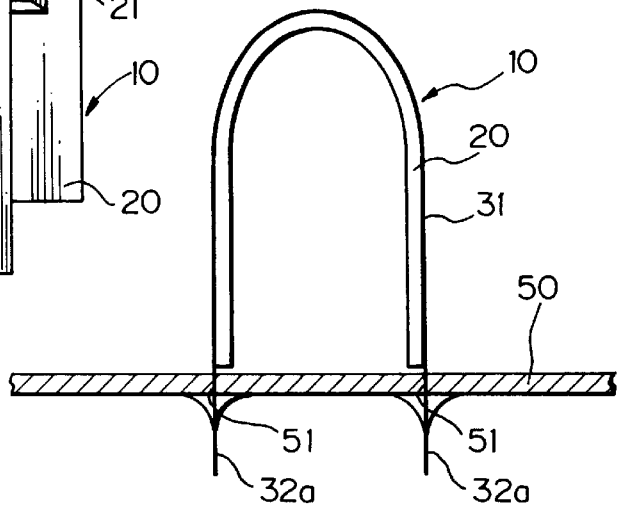
FIG. 10 is a cross sectional view of the bent plate fuse shown in FIG. 9, which is mounted on a print substrate.

On the other hand, in an embodiment shown in FIGS. 8 to 10, the plate fuse 10 is directly attached to the print substrate 50 without using the socket 40. As shown in FIG. 8, the circuit 31 including the fusible elements are laid on the insulation plate 10 so that the opposite ends of the circuit 31 protrude from the opposite ends of the insulation plate 20. The opposite protruding portions of the circuit constitute terminals 32*a*. As shown in FIG. 9, when the insulation plate 20 is bent, the opposite terminals 32*a*, 32*a* are directed down. As shown in FIG. 10, the terminals 32*a*, 32*a* thus directed down pass through holes 51, 51 in the print substrate 50 and are soldered to the print circuit on the rear side of the print substrate 50.

Such a structure will be useful in a limited application space since the structure does not require the socket 40, although the structure makes it difficult to attach and detach the plate fuse 10 to and from the print substrate 50.

Figure 11:
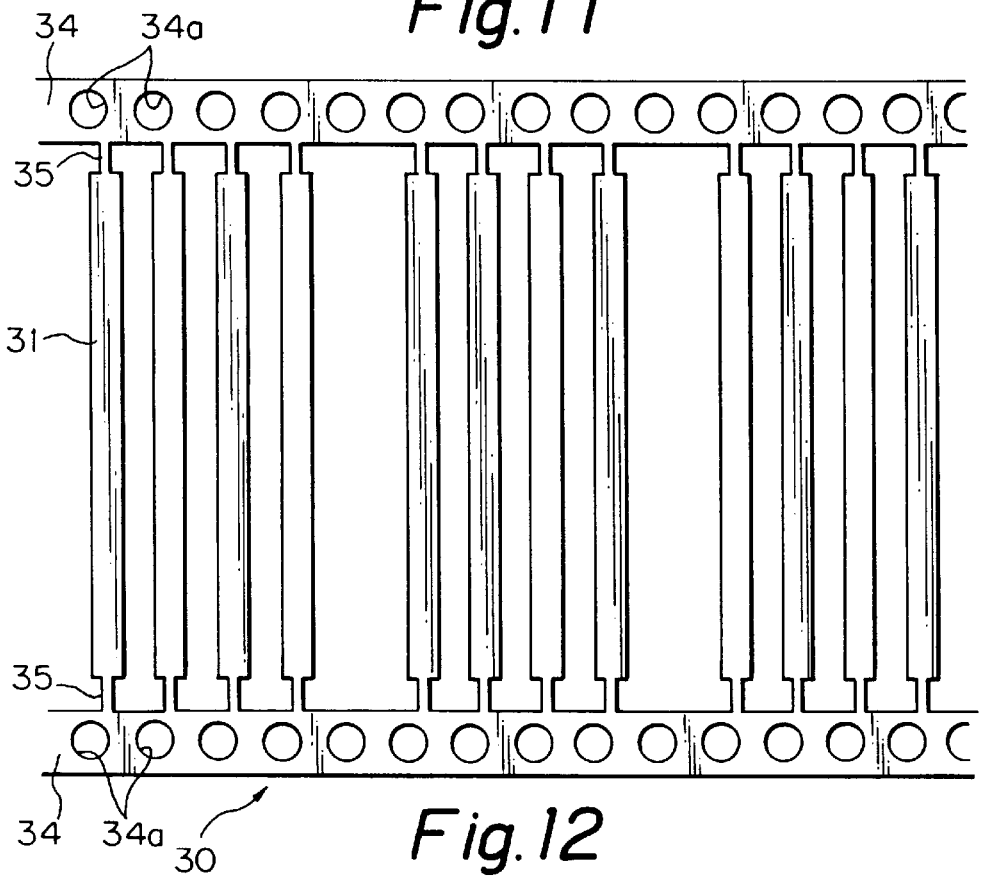
FIG. 11 is a plan view of a plurality of conductive circuits punched out from a fusible metal sheet.

The circuit 31 is punched out from a fusible metal sheet 30 having a relatively low melting point, as shown in FIG. 11. That is, the sheet 30 is supplied from a coil and punched into a plurality of circuits 31 successively so that the circuits 31 are connected through carriers 35, 35 to carriers 34, 34 on the opposite side ends of the sheet 30. A single plate fuse 10 is constituted from a set of four circuits 31 corresponding to the numbers of poles in the fuse 10. The set of four circuits 31 are spaced at an equal distance so as to be laid on the insulation plate 20 at an equal distance. A distance between the contiguous set of circuits is slightly wider than the distance between the adjacent circuits 31. The strip-like carriers 34, 34 are provided with pilot holes 34*a*, 34*a* which serve to feed the sheet 30.

Figure 12:
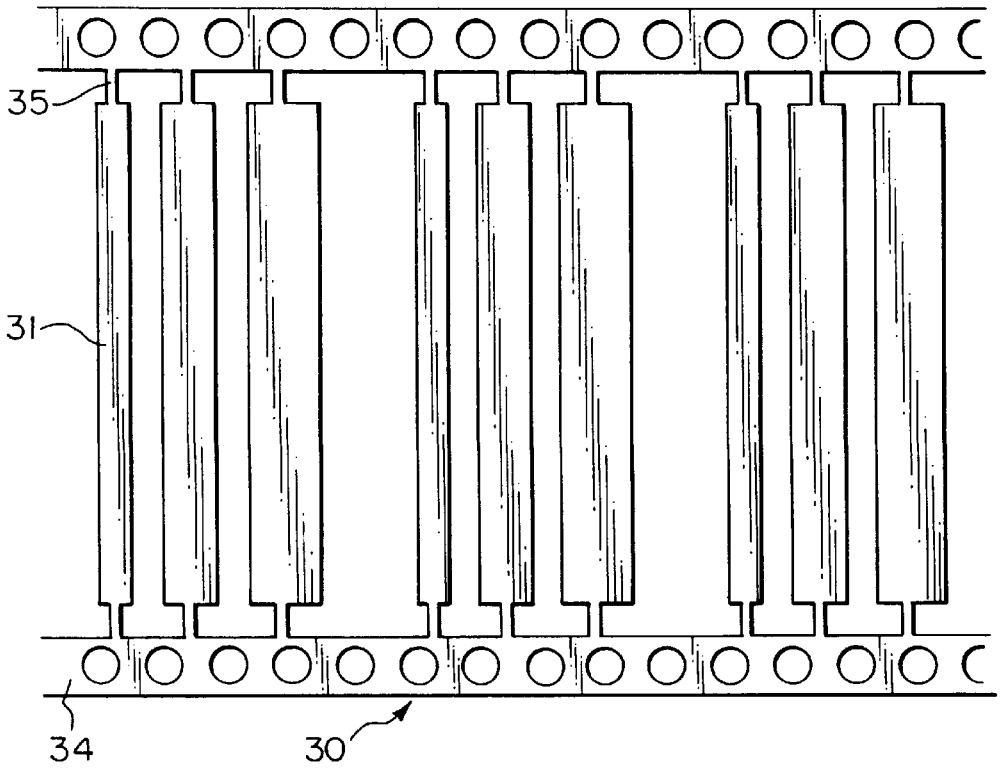
FIG. 12 is a plan view of another conductive circuits which are changed from the circuits shown in FIG. 11.
Figure 14:
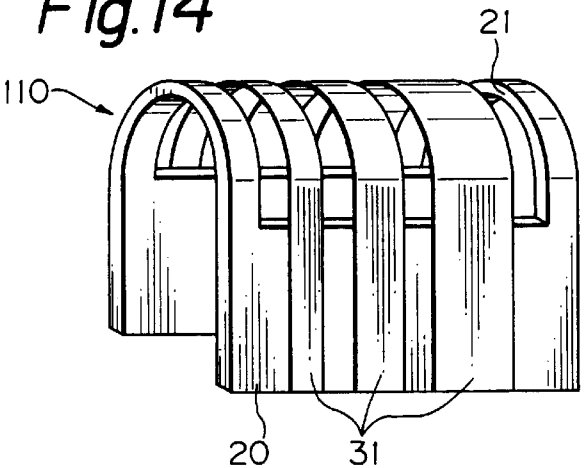

Each circuit 31 or each set of four circuits 31 may be punched out one by one or a plurality of sets of four circuits may be punched out successively. In this case of punching out each set of four circuits, it is possible to change a width of each circuit 31, as shown in FIG. 12. Thus, each plate fuse 110 has a plurality of circuits 31 with different widths and has a plurality of fusible paths with different current capacities in proportion to the width, as shown in FIG. 14.

Figure 17:
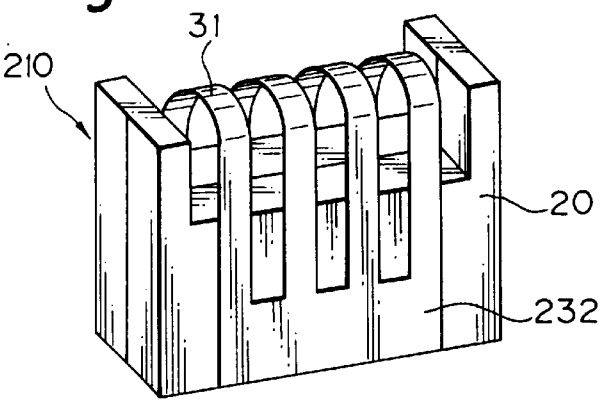
FIG. 16 and FIG. 17 are perspective views of bent plate fuses made of plate fuses using the conductive circuits shown in FIG. 13.
Figure 16:
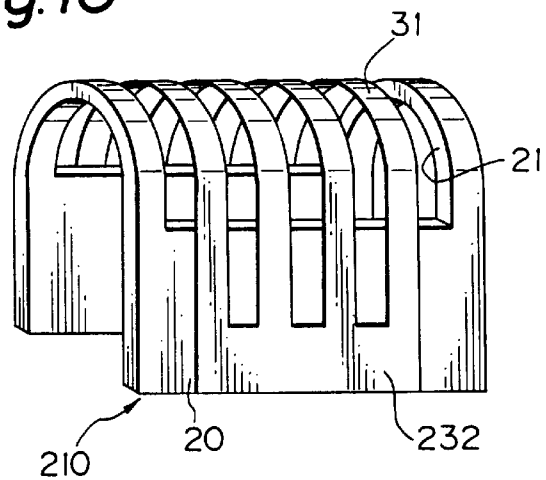

A plurality of circuits are not necessarily independent from each other. For example, as shown in FIG. 17, one end of the circuits may be connected to each other. In this case, the plate fuse 210 is provided on one side end with a common electric pole 232, as shown in FIG. 16, and on the other side end with an individual electric pole with each circuit. Such a structure has a merit that the respective circuits 31 can be hardly shifted from each other and that they are easily positioned in the following step.

Figure 18:
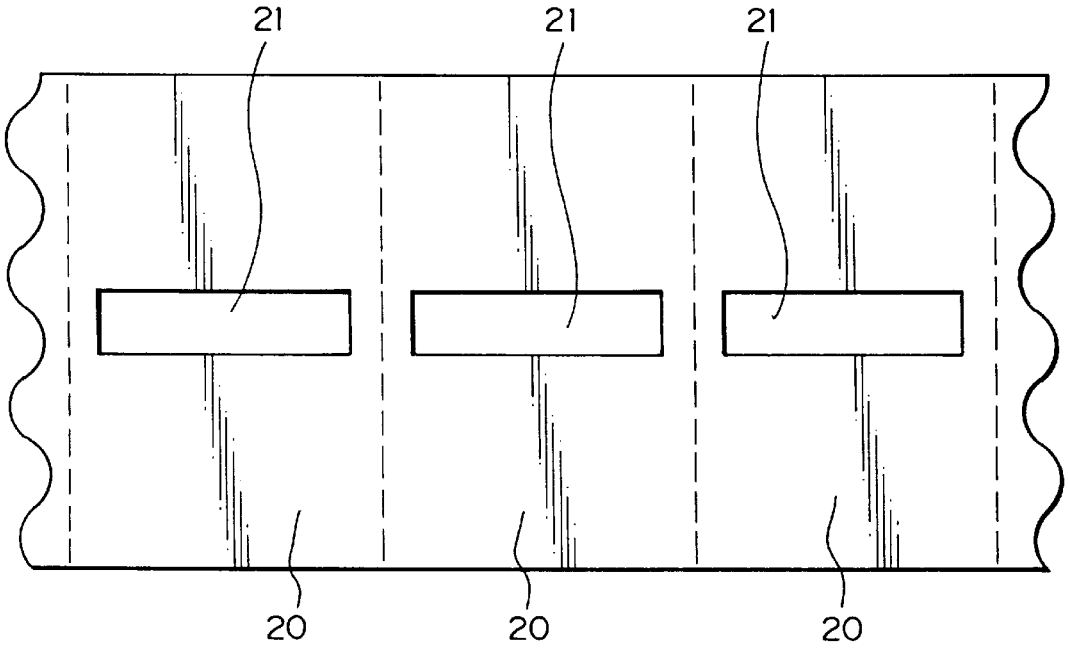
FIG. 18 is a plan view of an insulation plate to be used in the plate fuse of the present invention.
Figure 19:
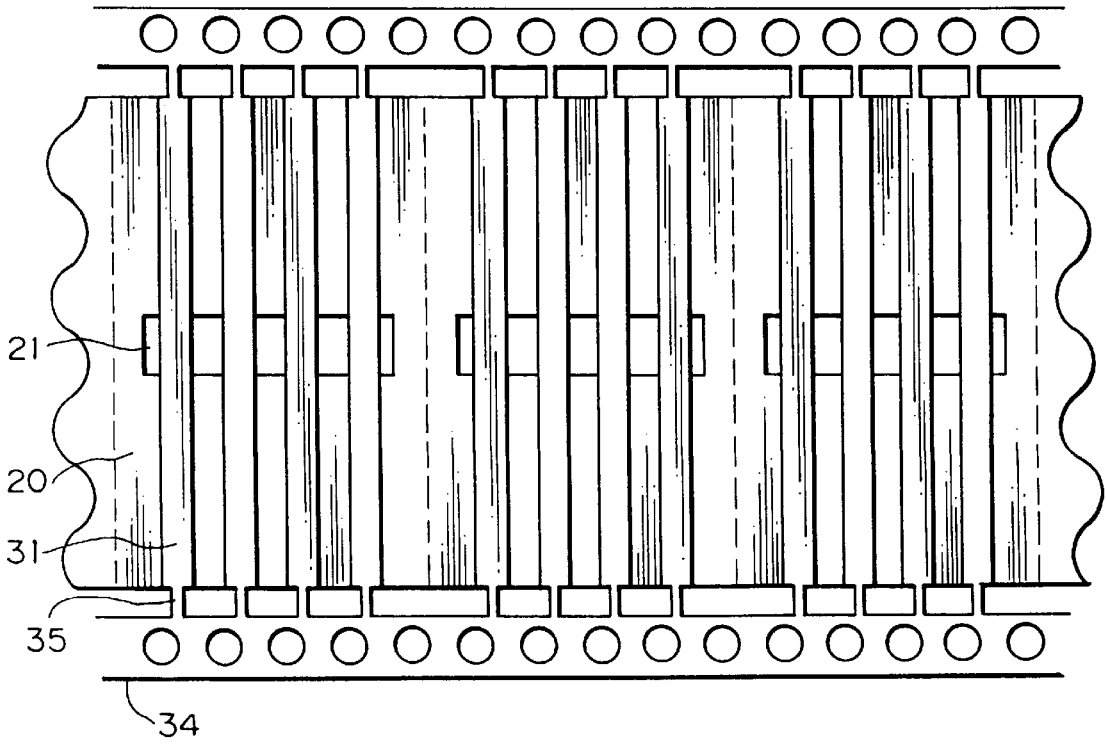
FIG. 19 is a plan view of the plate fuse under assembling, illustrating the conductive circuits disposed on the insulation plate shown in FIG. 18.
Figure 20:
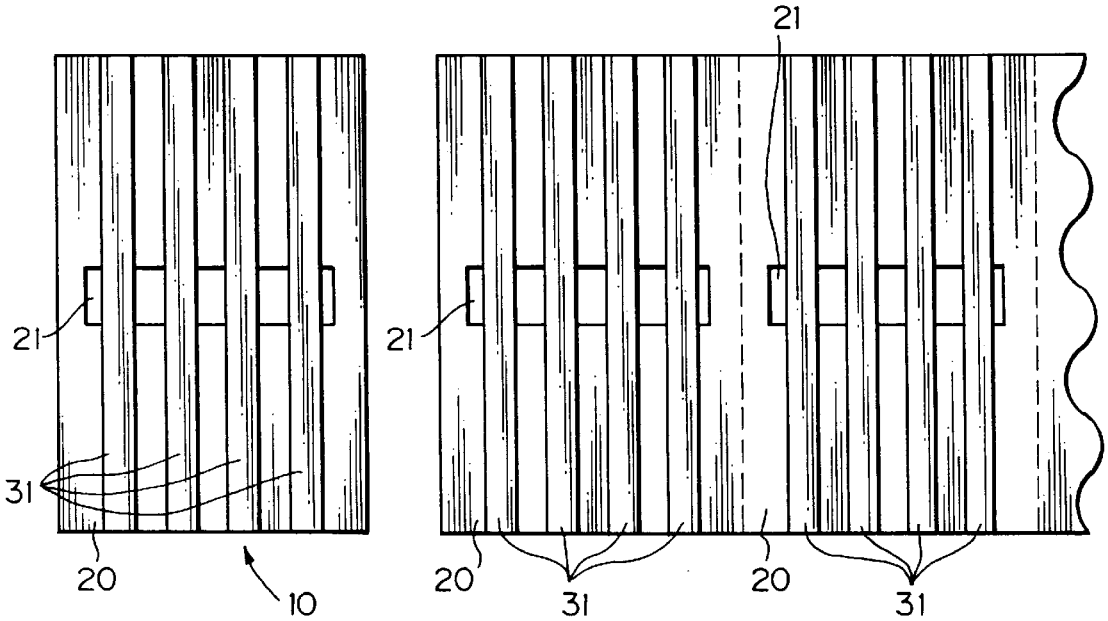
FIG. 20 is a plan view of the plate fuse shown in FIG. 19, illustrating the conductive circuits from which carriers are removed.

On the other hand, the insulation plate 20, as shown in FIG. 18, is supplied from a coil made of an insulation film continuously in accordance with a direction of a parallel arrangement of the circuits 31. The set of circuits 31 are punched out beforehand in accordance with a distance to be laid on the insulation plate 20 while a pitch between the sets of circuits 31 is set beforehand in accordance with a feeding pitch of the insulation plate 20. An adhesive is applied on a part of the surface of the insulation plate 20 on which the circuits 31 are to be laid. As shown in FIG. 19, a series of circuits 31 interconnected by the carriers 34, 34 and 35, 35 are laid on the continuous insulation plate 20 so that they are disposed on the part applied with the adhesive. Then, as shown in FIGS. 19 and 20, the carriers 35, 35 which interconnect the circuits 31 are cut off by a press and the insulation plate 20 is cut off simultaneously. Thus, it is possible to prevent the many circuits 31 from being shifted on the insulation plate 20 since they are laid on the plate 20 while the carriers 34, 34 support the circuits 31. Thus, the plate fuse 10 shown in FIG. 1 is completed by the processes described above.

Figure 13:
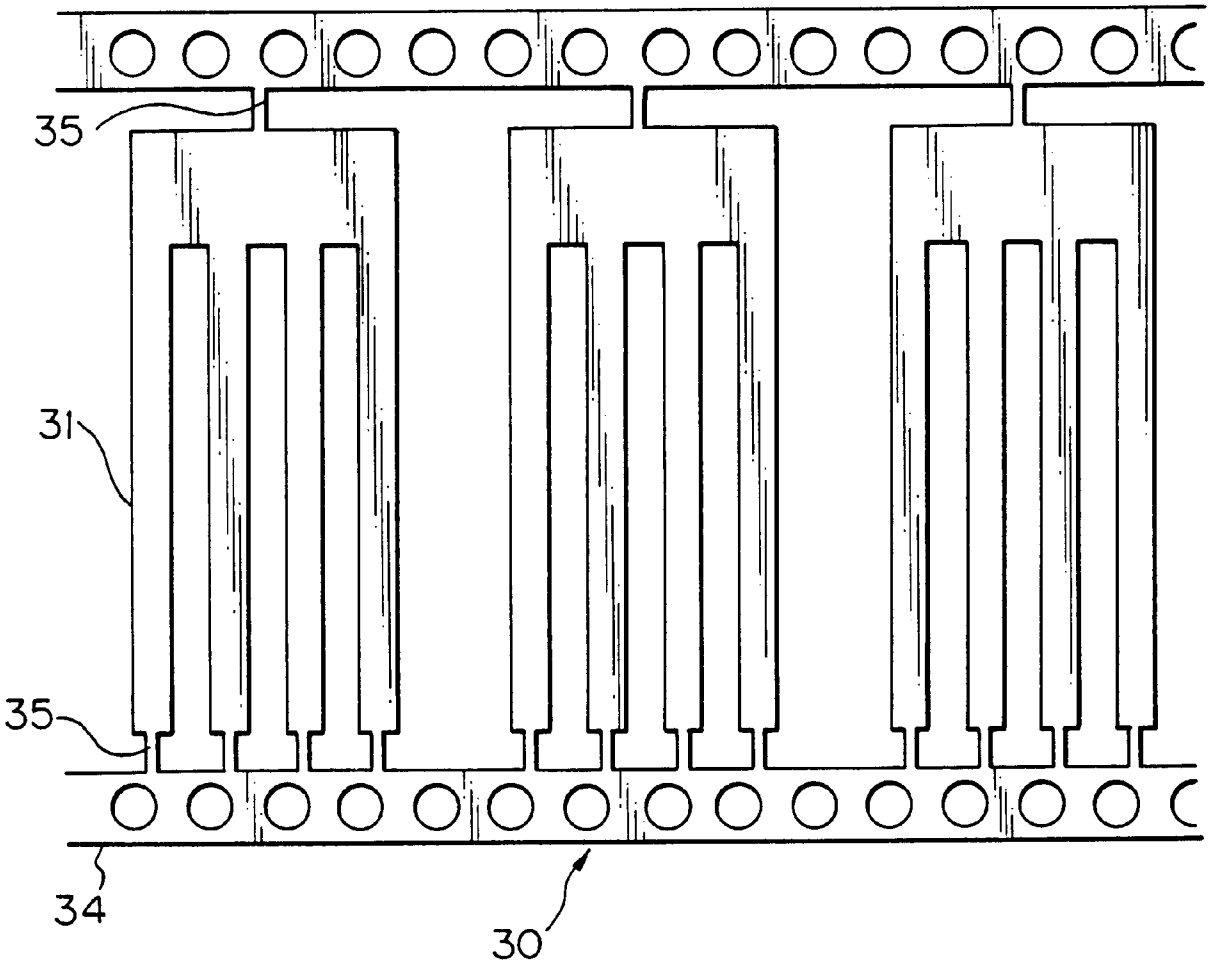
FIG. 13 is a plan view of still another conductive circuits which are changed from the circuits shown in FIG. 11.

In this embodiment, many sets of four circuits 31 are interconnected by the carriers 34 and 35 and laid on the insulation plate 20. Every set of circuits 31 may be laid on every insulation plate 20 by cutting off the carriers 34 and 35, so long as the punched-out circuits 31 are laid on the insulation plate 20. In this case, as shown in FIG. 13, the respective circuits 31 are hardly scattered so long as the respective circuits 31 are interconnected at their one ends. However, an automatic production of the plate fuse 10 can be easily effected by successively feeding the circuits by means of the carriers 34 and 35 and by successively feeding the insulation plate 20 in synchronization with the feeding of the circuits 31.

Next, an operation of this embodiment constructed above will be explained below.

When the opposite ends of the plate fuse 10 are inserted into the openings 41, 41 in the sockets 40, 40, the electric poles 32 of the circuits 31 laid on the surface of the plate fuse 10 are clamped between the stationary electric poles 42, 42 to form a series of conductive path.

Figure 2:
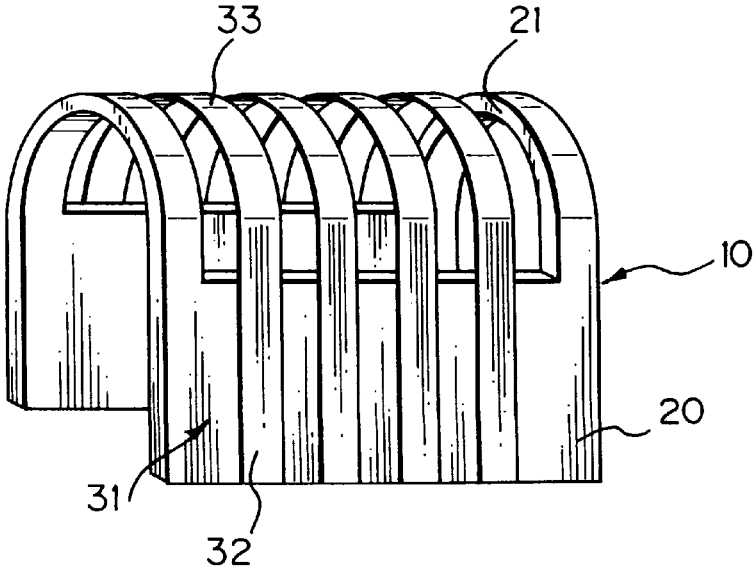
FIG. 2 is a perspective view of a bent plate fuse made of the plate fuse shown in FIG. 1.

The circuit 31 commences to generate heat in response to a current flow. At this time, a part of the circuit 31 across the slot 21, which does not absorb the heat, generates the heat concentrically. When a current flows over an allowable current capacity which depends on a material and an area in cross section of the fusible element, the fusible path 33 spanned in air across the slot 21 melts to cut off the electrical path. The fusible element always melts at the portion spanned in air across the slot 21. If the fusible element melts on the insulation plate 20, it will be scorched and produces white smoke or an offensive smell. However, a fusible element which melts in air is free of such problems. Even if the fusible element does not melt, each circuit 31 repeats its heat expansion and contraction. In this case where the portion spanned in air across the slot is held in a bent posture, as shown in FIG. 2, stress concentration due to heat expansion and contraction will not occur in the bent portion spanned in air. Consequently, metal fatigue will not occur in the portion, thereby extending the life of the plate fuse.

As described above, when the circuit 31 including the fusible element is laid on the surface of the insulation plate 20, it is provided beforehand with a window or slot 21 and the circuit is laid on the plate across the slot 21. Accordingly, since the heat generated in the fusible path 33 spanned in air across the slot 21 is not absorbed in the insulation plate 20 when the circuit 31 is heated by electrical conduction, the fusible path 33 is subject to a temperature increase and melts. Since the insulation plate 20 is made of an insulation film, it can be transformed in accordance with the space available. It should be noted that the plate fuse and the method of producing the same in accordance with the present invention are not limited to the above embodiments. For example, a suitable protective casing may be provided on the fusible element upon mounting the plate fuse on the device.

Next, referring now to FIGS. 6, 7, 11 to 13, 15, 17, and 21 to 25, another embodiment of a plate fuse of the present invention will be described below.

Figure 6:
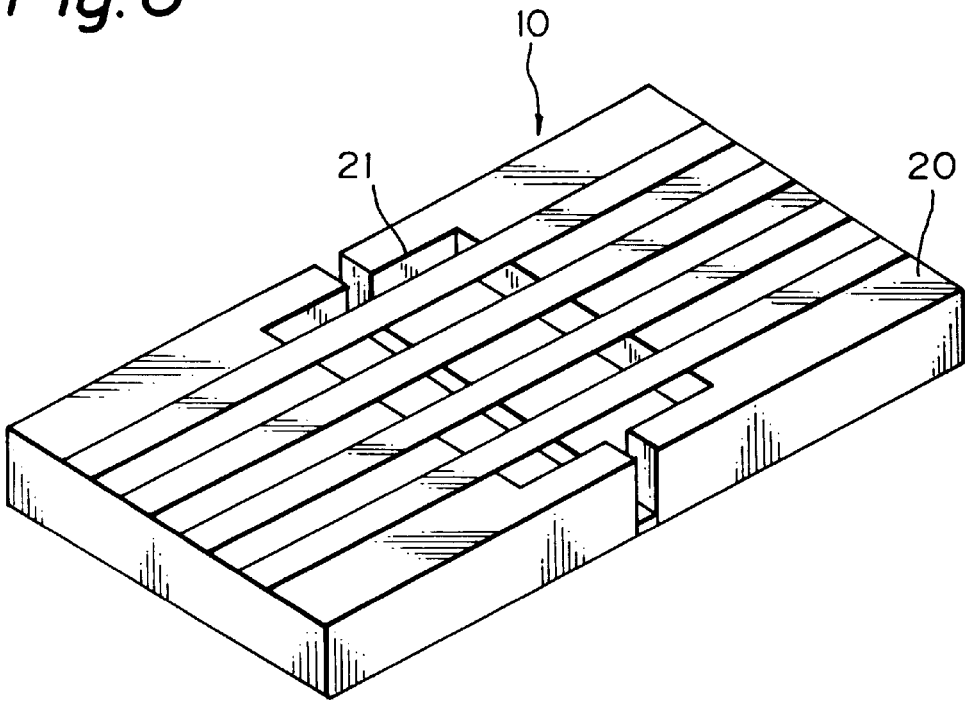
FIG. 6 is a perspective view of another embodiment of a plate fuse in accordance with the present invention.
Figure 7:
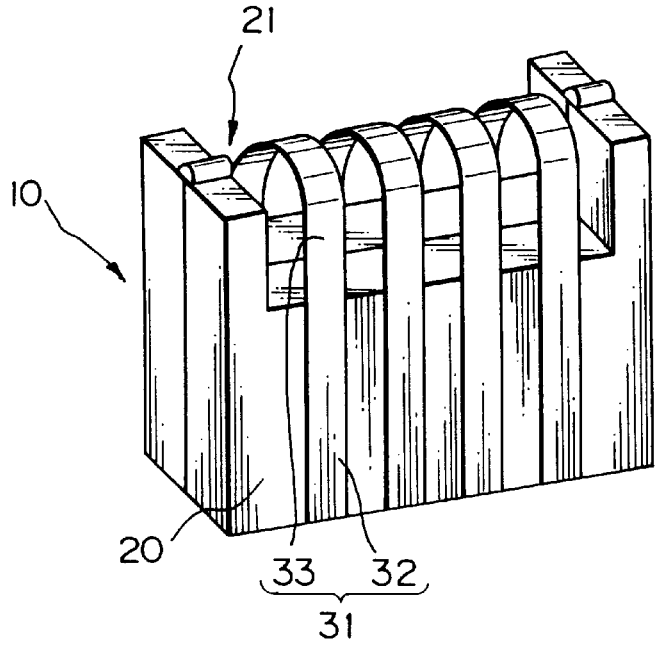
FIG. 7 is a perspective view of a bent plate fuse made of the plate fuse shown in FIG. 6.

FIGS. 6 and 7 are perspective views of a plate fuse 10 produced by an embodiment of the producing method of this invention.

In FIGS. 6 and 7, the rectangular insulation plate 20 is provided in its middle portion with a slot or window 21 which extends across a substantially whole width of the plate 20. A set of four circuits 31 including a tape-like fusible element 15 laid on the insulation plate 20 in parallel to each other. The circuits are bent at their middle portions. The circuit 31 has an electric pole 32 at each of the opposite ends thereof and a fusible path 33 between the electric poles 32 and 32, in particularly, at the portion spanned in air across the slot 21.

In this embodiment, the insulation plate 20 is bent into a U-shape. However, it is not necessarily bent so long as the circuit 31 is laid on the surface of the plate 20. Since the circuit 31 is laid on the plate 20 to cross the slot 21, a part of the circuit 31 is spanned in air, thereby making the part or fusible path 33 more fusible.

The circuit 31 is punched out from a fusible metal sheet 30 having a relatively low melting point, as shown in FIG. 11. That is, the sheet 30 is supplied from a coil and punched into a plurality of circuits 31 successively so that the circuits 31 are connected through carriers 35, 35 to carriers 34, 34 on opposite side ends of the sheet 30. A single plate fuse 10 is constituted from a set of four circuits 31 corresponding to the numbers of poles in the fuse 10. The set of four circuits 31 are spaced at an equal distance so as to be laid on the insulation plate 20 at an equal distance. A distance between the contiguous set of circuits is slightly wider than the distance between the adjacent circuits 31. The strip-like carriers 34, 34 are provided with pilot holes 34*a*, 34*a* which serve to feed the sheet 30.

Figure 15:
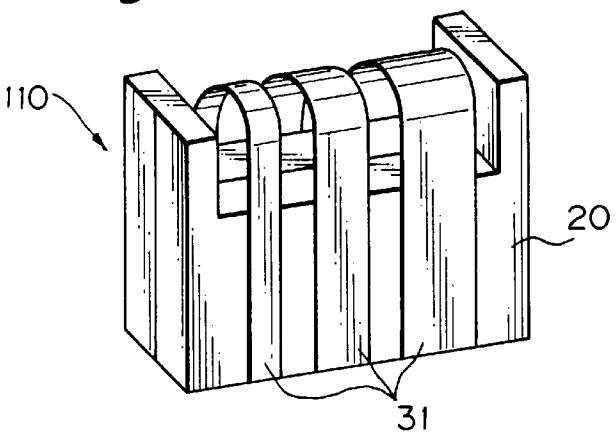
FIG. 14 and FIG. 15 are perspective views of bent plate fuses made of plate fuses using the conductive circuits shown in FIG. 12.

Each circuit 31 or each set of four circuits 31 may be punched out one by one or a plurality of sets of four circuits may be punched out successively. In this case of punching out each set of four circuits, it is possible to change a width of each circuit 31, as shown in FIG. 12. Thus, each plate fuse 110 has a plurality of circuits 31 with different widths and has a plurality of fusible paths with different current capacities in proportion to the width, as shown in FIG. 15.

The plurality of circuits is not necessarily independent from each other. For example, as shown in FIG. 13, one end of the circuits may be connected to each other. In this case, the plate fuse 210 is provided on one side end with a common electric pole 232, as shown in FIG. 17, and on the other side end with an individual electric pole for each circuit. Such a structure has a merit that the respective circuits 31 will not readily move apart from each other and that they can be easily positioned in the following step.

Figure 21:
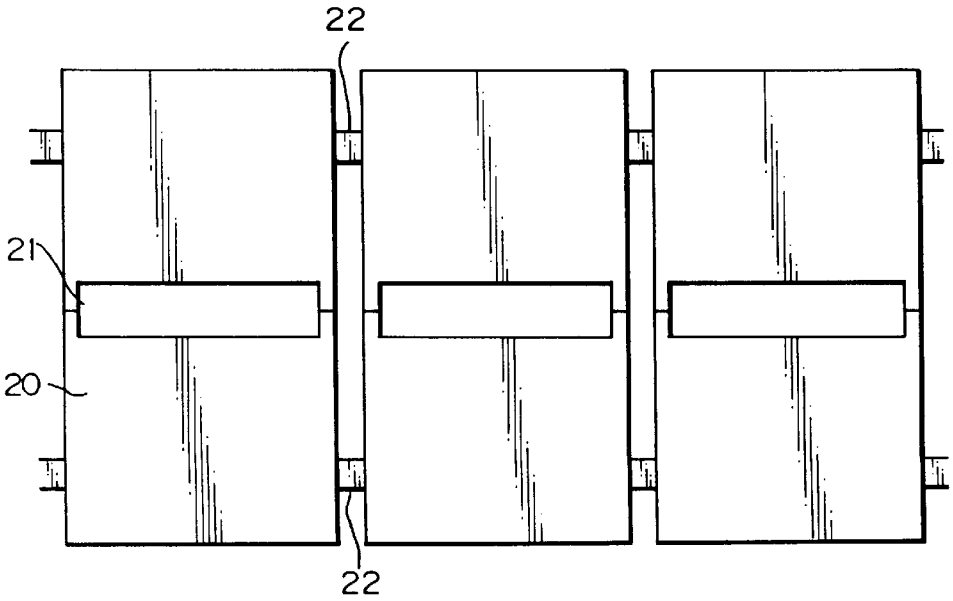
FIG. 21 is a plan view of another insulation plate.
Figure 22:
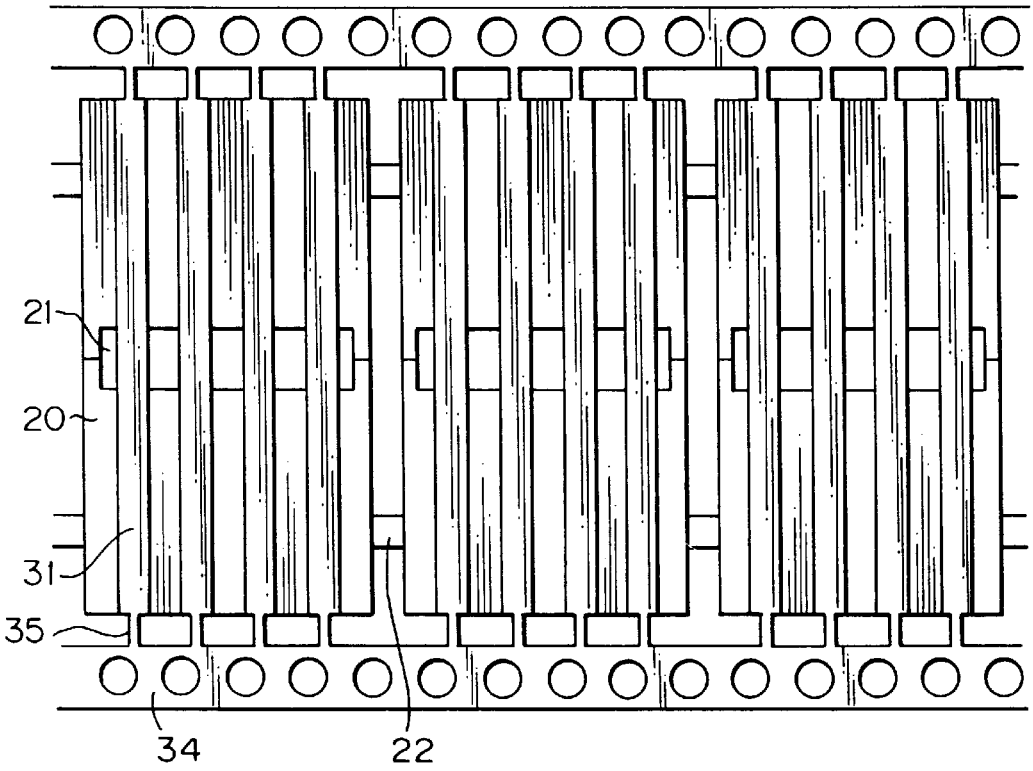
FIG. 22 is a plan view of the plate fuse under assembling, illustrating the conductive circuits disposed on the insulation plate shown in FIG. 21.
Figure 23:
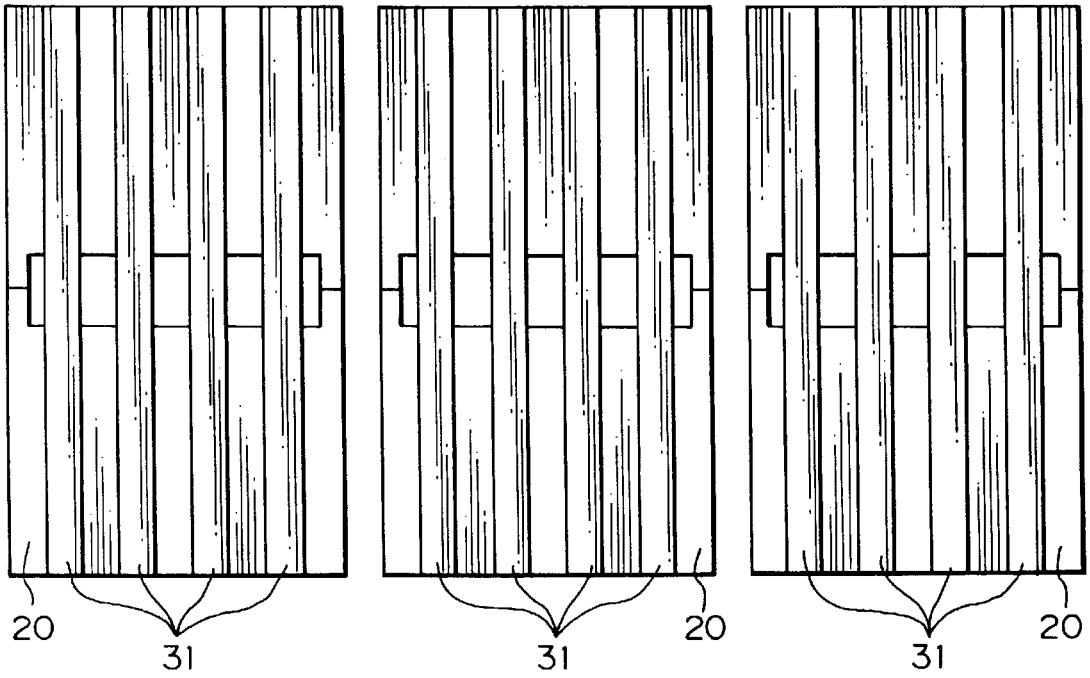
FIG. 23 is a plan view of the plate fuse shown in FIG. 22, illustrating the conductive circuits from which carriers are removed.

On the other hand, the insulation plates 20, as shown in FIG. 21, are connected through carriers 22 continuously in accordance with a direction of a parallel arrangement of the circuits 31. The set of circuits 31 are punched out beforehand in accordance with a distance between the contiguous insulation plates 20. An adhesive is applied on a part of the surface of the insulation plate 20 on which the circuits 31 are to be laid. As shown in FIG. 22, a series of circuits 31 interconnected by the carriers 34, 34 and 35, 35 are laid on the continuous insulation plate 20 so that they are disposed on the part applied with the adhesive. Then, as shown in FIG. 23, the carriers 35, 35 which interconnect the circuits 31 are cut off by a press and the carriers 22 of the insulation plate 20 are cut off simultaneously. Thus, it is possible to prevent the many circuits 31 from moving on the insulation plate 20 since they are laid on the plate 20 while the carriers 34, 34 support the circuits 31.

In this embodiment, many sets of four circuits 31 are interconnected by the carriers 34 and 35 and laid on the insulation plate 20. Every set of circuits 31 may be laid on every insulation plate 20 by cutting off the carriers 34 and 35, so long as the punched-out circuits 31 are laid on the insulation plate 20. In this case, as shown in FIG. 13, the respective circuits 31 are hardly scattered so long as the respective circuits 31 are interconnected at their one ends. However, automatic production of the plate fuse 10 can be easily effected by successively feeding the circuits by means of the carriers 34 and 35 and by successively feeding the insulation plate 20 in synchronization with the feeding of the circuits 31.

The circuits 31 may not be necessarily parallel to each other. In the case where the circuits 31 are interconnected through carriers, desired circuits may be formed and laid on the insulation plate 20 with the circuits being interconnected by the carriers. Thereafter, the carriers may be cut off. In order to secure the circuit 31 to the insulation plate 20, the adhesive may be applied to the rear side of a fusible metal sheet 30 wound in coil except for the insulation plate 20.

Figure 24:
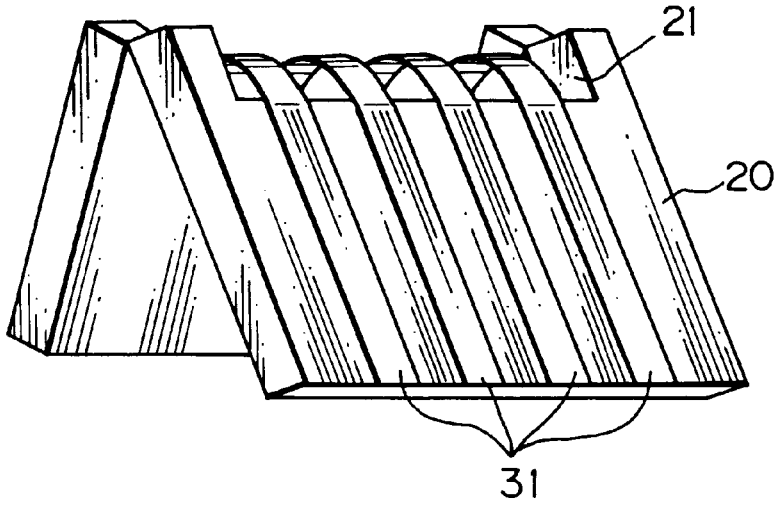
FIG. 24 is a perspective view of the plate fuse which is being bent.

The plate fuse 10 shown in FIG. 7 is completed by bending the insulation plate 20 into the U-shape at the slot 21, as shown in FIG. 24, after the circuits 31 have been laid on the insulation plate 20.

Figure 25:
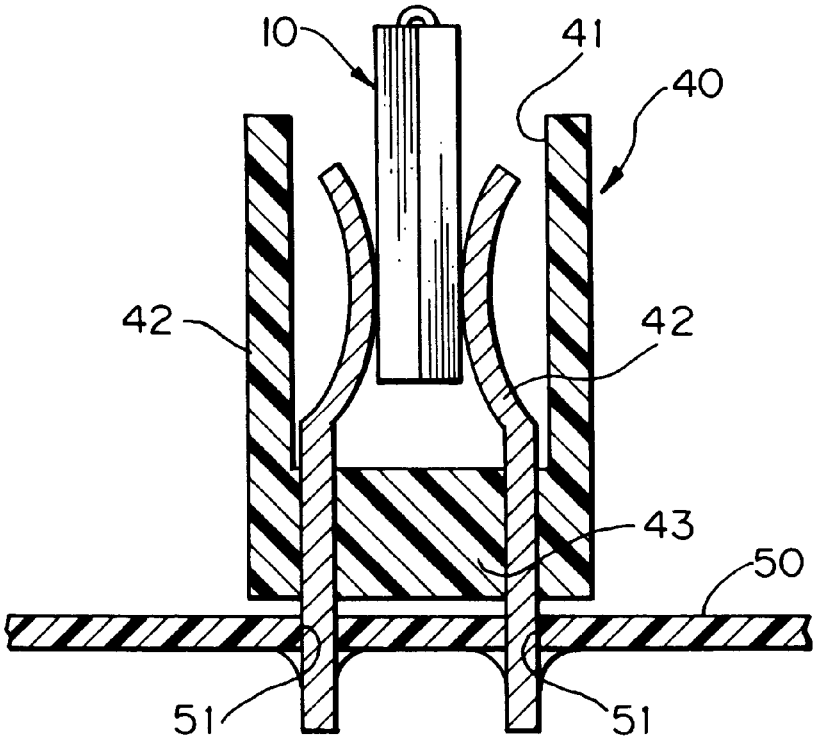
FIG. 25 is a cross sectional view of a socket which uses the plate fuse.
Figure 26:
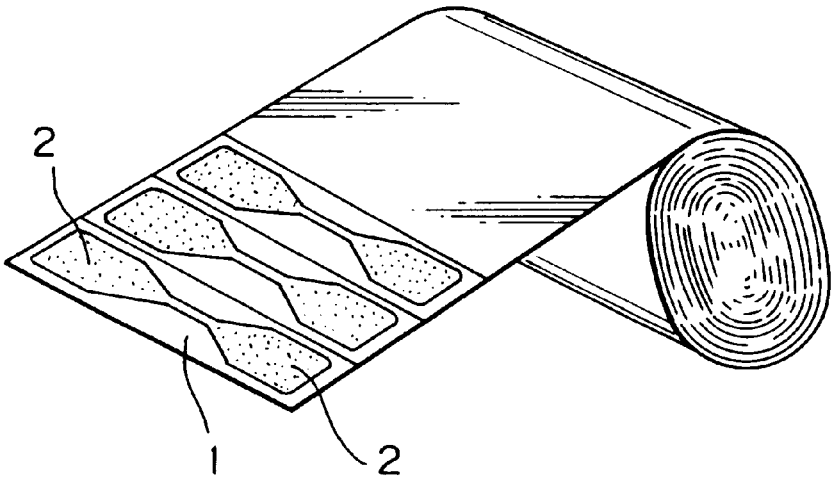
Fig. 26 PRIOR ART
FIG. 26 is an explanatory view illustrating a method of producing a conventional plate fuse.
Figure 27:
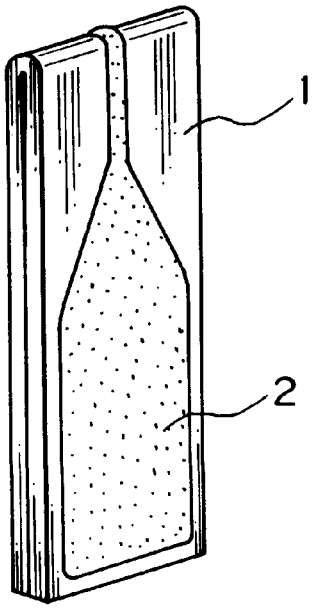
Fig. 27 PRIOR ART
FIG. 27 is an explanatory view illustrating a method of producing a conventional plate fuse.
Figure 28:
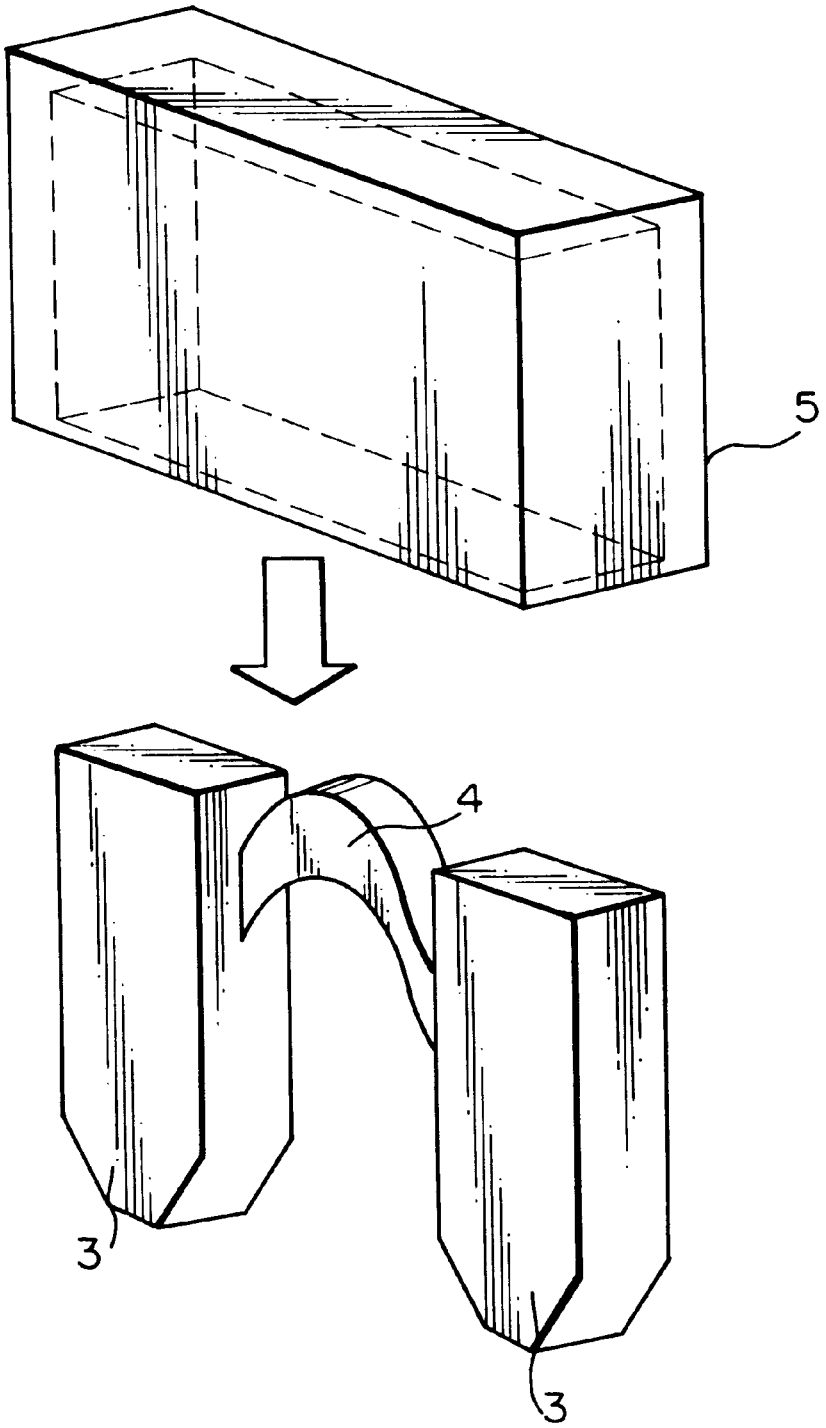
Fig. 28 PRIOR ART
FIG. 28 is an exploded perspective view of another conventional fuse.

Such a plate fuse 10 is used by inserting lower ends of the fuse 10 into the openings in the socket 40, as shown in FIG. 25. The socket 40 has stationary electric poles 42, 42 in the opening 41, which face the electric poles 32, 32 of the plate fuse 10 to hold them. Ends of the stationary electric poles 42, 42 pass through the bottom wall 43 in the opening 41 and project rearwards. The socket 40 is mounted on a print substrate 50 so that the ends of the stationary electric poles 42, 42 pass through holes 51, 51 in the print substrate 50. The projecting ends of the poles 42, 42 are soldered to a print circuit on the rear side of the print substrate 50. Accordingly, when the plate fuse 10 is inserted into the socket 40, the print circuit is conducted through the circuit 31. If a current flows in the plate fuse over a given current capacity, the fusible path 33 is melted.

In the plate fuse 10 of this invention, the circuits 31 are punched out from the fusible metal sheet 30 by a press and the electric poles 32 and fusible paths 33 of the circuits 31 are laid on the insulation plate 20. These operations can be carried out in a dry process, thereby enhancing an efficiency of working, forming a plurality of circuits at the same time, and enabling the current capacity to be changed every circuit.

What is claimed is:

1. A circuit fuse assembly comprising an insulation plate and a substrate carrying electrical circuitry;

said insulation plate comprising a flexible insulation film having a window therein, at least one conductive strip, on a surface of said insulation plate, having terminals extending beyond each end of said insulation film, said conductive strip having a predetermined current capacity;

said strip spanning said window in air, said insulation plate being bent at said window into a U-shape, said substrate having openings therein, said terminals passing through said opening to affix said insulation plate to said substrate and in electrical contact with said electrical circuitry.

2. The circuit fuse assembly of claim 1 wherein said insulation plate is affixed to said substrate by soldering said terminals.

3. The circuit fuse assembly of claim 1 wherein there is a plurality of conductive strips on said surface of said insulation plate.

* * * * *